US010547104B2

(12) United States Patent
Huang

(10) Patent No.: US 10,547,104 B2
(45) Date of Patent: Jan. 28, 2020

(54) ANTENNA

(71) Applicant: Trans Electric Co., Ltd., Changhua (TW)

(72) Inventor: Jui-Chin Huang, Changhua (TW)

(73) Assignee: Trans Electric Co., Ltd., Changhua (TW)

( * ) Notice: Subject to any disclaimer, the term of this patent is extended or adjusted under 35 U.S.C. 154(b) by 0 days.

(21) Appl. No.: 16/134,178

(22) Filed: Sep. 18, 2018

(65) Prior Publication Data

US 2019/0393594 A1 Dec. 26, 2019

(30) Foreign Application Priority Data

Jun. 25, 2018 (TW) ..... 107208517 U

(51) Int. Cl.
*H01Q 19/30* (2006.01)
*H01Q 1/48* (2006.01)

(52) U.S. Cl.
CPC ..... *H01Q 1/48* (2013.01); *H01Q 19/30* (2013.01)

(58) Field of Classification Search
CPC ..... H01Q 1/243; H01Q 9/285; H01Q 1/38; H01Q 1/48; H01Q 19/30
See application file for complete search history.

(56) References Cited

U.S. PATENT DOCUMENTS

2011/0090131 A1* 4/2011 Chen ..... H01Q 19/30 343/815
2013/0069837 A1* 3/2013 Cozzolino ..... H01Q 13/10 343/727
2014/0266953 A1* 9/2014 Yen ..... H01Q 9/065 343/818

* cited by examiner

*Primary Examiner* — Dameon E Levi
*Assistant Examiner* — Hasan Z Islam
(74) *Attorney, Agent, or Firm* — Burris Law, PLLC

(57) ABSTRACT

An antenna includes a conductor portion, a grounding portion and a radiator portion. The grounding portion includes a main section, first and second wings and a line section. The first and second wings extend respectively from opposite ends of the main section toward the conductor portion. The line section includes a base segment extending from the main section between the first and second wings toward the conductor portion, and an extension segment extending from the base segment toward the first wing. The radiator portion includes a feeding point adjacent to the main section, a base line extending from the feeding point toward the conductor portion and an extension section extending from the base line toward the second wing.

11 Claims, 7 Drawing Sheets

ANTENNA

CROSS-REFERENCE TO RELATED APPLICATION

This application claims priority of Taiwanese Patent Application No. 107208517, filed on Jun. 25, 2018.

FIELD

The disclosure relates to an antenna, and more particularly to an antenna applied to digital television bandwidths.

BACKGROUND

In the recent years, many countries has focused on promoting digital television (DTV) services to effectively use available finite frequency bands and to improve quality of audio and video transmission. Antennas for receiving signals transmitted by wireless TV stations serve as intermediate elements between an audio-video device and the wireless TV stations. The antennas convert electric signal to electromagnetic wave and vise versa, and are configured to reduce attenuation loss of electromagnetic wave at a specific frequency band to thereby increase signal-to-noise ratio (SNR) of received signals.

Referring to FIG. 1, a conventional antenna includes two hollowed symmetric triangular structures 11 for transceiving signals having a frequency falling within a bandwidth, for example 470~700 MHz, for DTV. The conventional antenna provides antenna gain as shown by a dashed line in FIG. 3.

SUMMARY

Therefore, an object of the disclosure is to provide an antenna having a relatively good transceiving performance.

According to an aspect of the disclosure, an antenna includes a conductor portion, a grounding portion, and a radiator portion. The conductor portion extends in a first direction. The grounding portion includes a main grounding section, a first wing section, a second wing section and a grounding line section. The main grounding section extends in the first direction, is spaced apart from the conductor portion in a second direction transverse to the first direction, and has two ends opposite to each other in the first direction. The first wing section and the second wing section extend in the second direction respectively from the two ends of the main grounding section toward the conductor portion, and are spaced apart from each other in the first direction. The grounding line section extends from the main grounding section, and includes a base line segment and at least one extension segment. The base line segment extends in the second direction from a portion of the main grounding section between the first wing section and the second wing section toward the conductor portion, and has a distal end close to the conductor portion. The extension segment extends from the distal end of the base line segment in the first direction toward the first wing section. The radiator portion is disposed between the second wing section and the grounding line section and includes a feeding point, a base line section and at least one extension section. The feeding point is disposed adjacent to the main grounding section. The base line section extends from the feeding point toward the conductor portion and has a distal portion close to the conductor portion. The extension section extends from the distal portion of the base line section toward the second wing section.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
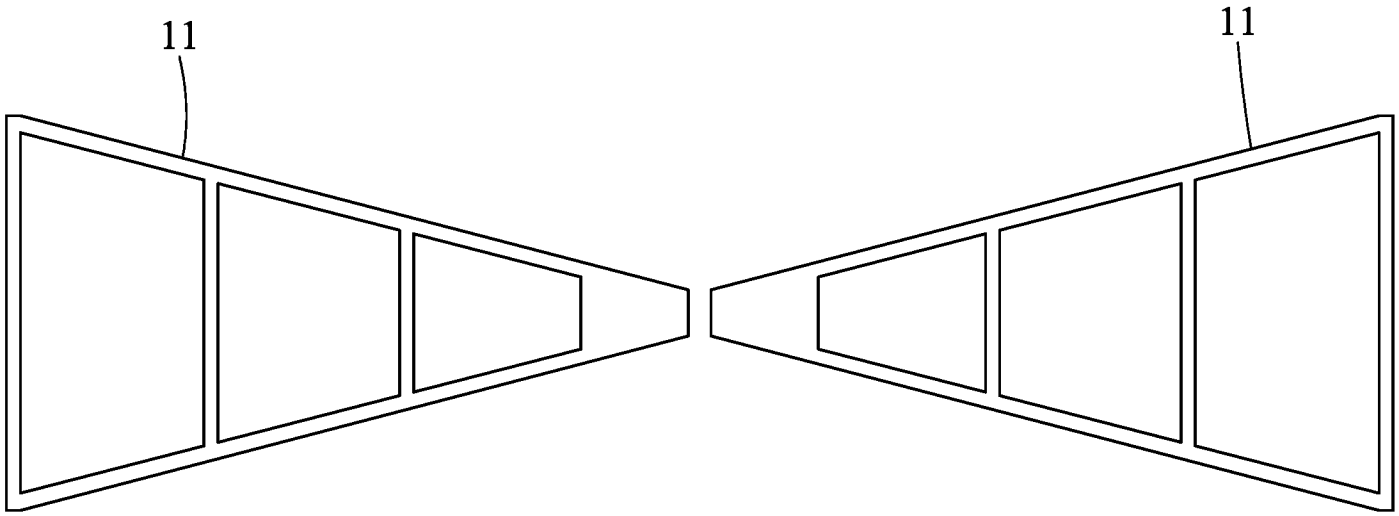
FIG.1 PRIOR ART
FIG. 1 is a schematic view of a conventional antenna.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
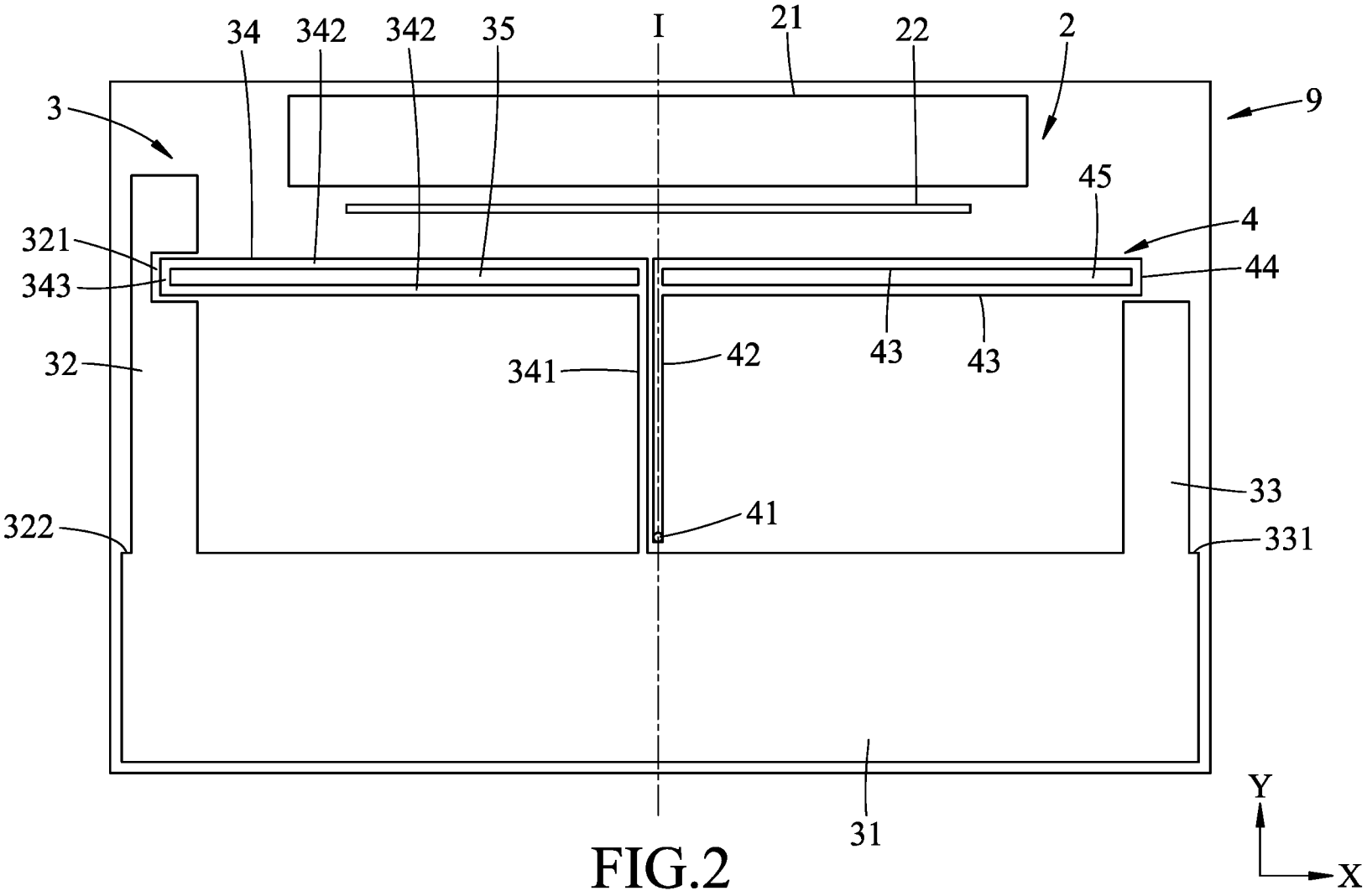
FIG. 2 is a schematic view of an antenna of a first embodiment according to the present disclosure.

Referring to FIG. 2, an antenna of a first embodiment according to the present disclosure includes a conductor portion 2, a grounding portion 3, a radiator portion 4 and a dielectric substrate 9. The dielectric substrate 9 has opposite surfaces, and the conductor portion 2, the grounding portion 3 and the radiator portion 4 are disposed at the same one of the surfaces of the dialectic substrate 9 such that the antenna of the present disclosure is implemented in a single layer structure. The dielectric substrate 9 can be made of insulating material, such as plastic, fiberglass, bakelite, etc. The conductor portion 2, the grounding portion 3 and the radiator portion 4 of the antenna can be formed by coating or electroplating conductive material, such as silver, cooper on the dielectric substrate 9 but the present disclosure is not limited in this respect.

The conductor portion 2 is located at an upper portion in FIG. 2, and includes a main conductor 21 and an auxiliary conductor 22, both of which extend in a first direction (X). The auxiliary conductor 22 is spaced apart from the main conductor 21 in a second direction (Y) transverse to the first direction (X), is disposed between the radiator portion 4 and the main conductor 21 and has an area smaller than that of the main conductor 21.

The conductor portion 2 has floating potential and is substantially symmetric with respect to an imaginary line (I) extending in the second direction (Y). In particular, the imaginary line (I) is a center line of the substrate 9. The main conductor 21 and the auxiliary conductor 22 are both substantially rectangular in this embodiment. Note that the term "symmetric" as used herein means two elements that are symmetric in terms of geometric shape and may have some minor differences in size.

The main conductor 21 has a length of 132±35 mm in the first direction (X), i.e., ranging from 97 mm to 167 mm, preferably 132 mm, and a width of 16±4 mm in the second direction (Y), i.e., ranging from 12 mm to 20 mm, preferably 16 mm. In the following description, the expression of (A)±(B) mm represents that the depicted size may range from (A+B) mm to (A−B) mm and (A) mm is a preferable example. The auxiliary conductor 22 has a length of 112±30 mm in the first direction (X) and a width of 1.5±0.4 mm in the second direction (Y). A distance between the main conductor 21 and the auxiliary conductor 21 is 3±1 mm. Note that, the function of the conductor 2 is similar to that of a director of Yagi-Uda antenna, which is also known as a parasitic element and is capable of increasing directivity and gain of the antenna.

The grounding portion 3 is grounded and includes a main grounding section 31, a first wing section 32, a second wing section 33 and a grounding line section 34. The main grounding section 31 is located at a lower portion in FIG. 2, extends in the first direction (X), is spaced apart from the conductor portion 2 in the second direction (Y), is substantially symmetric with respect to the imaginary line (I), and has two ends opposite to each other in the first direction (X). The main grounding section 31 has a length of 193±50 mm in the first direction (X) and a width of 38±10 mm in the second direction (Y).

The first wing section 32 and the second wing section 33 extend in the second direction (Y) respectively from the two (upper left and upper right) ends of the main grounding section 31 toward the conductor portion 2, and are spaced apart from each other in the first direction (X). In this embodiment, the first wing section 32 has a length in the second direction (Y) greater than that of the second wing section 33, and is formed with an indented portion 321.

The first wing section 32 has a length of 67±15 mm in the second direction (Y) and a width of 12±3 mm in the first direction (X). The indented portion 321 is in the shape of a rectangle and is defined by a left side extending in the second direction (Y) and facing an opening of the indented portion 321, and upper and lower sides extending in the first direction (X) and spaced apart from each other in the second direction (Y). Each of the upper and lower sides has a length of 8.3±2 mm in the first direction (X), and the left side has a length of 8.5±2 mm in the second direction (Y). A distance between an upper right vertex of the first wing section 32 (in FIG. 2) and the main conductor 21 in the first direction (X) is 16±4 mm. The second wing section 33 has a length of 44±10 mm in the second direction (Y) and a width of 12±3 mm in the first direction (X).

A distance between a left side of the first wing section 32 and a left end of the main grounding section 31 (i.e., a distance of a segment 322 in FIG. 2) and a distance between a right side of the second wing section 33 and a right end of the main grounding section (i.e., a distance of a segment 331 in FIG. 2) are both 2±0.5 mm.

The grounding line section 34 extends from the main grounding section 31, and includes a base line segment 341, two extension segments 342 and a connecting segment 343. The base line segment 341 extends in the second direction (Y) from a portion of the main grounding section 31 between the first wing section 32 and the second wing section 33 toward the conductor portion 2, and has a distal end close to the conductor portion 2. In particular, the base line segment 341 extends from a portion of the main grounding section 31 adjacent to the imaginary line (I). The extension segments 342 extend from the distal end of the base line segment 341 in the first direction (X) toward the first wing section 32 and are spaced apart from each other in the second direction (Y). The connecting segment 343 extends in the second direction (Y) and interconnects terminal ends respectively of the extension segments 342. The extension segments 342, the connecting segment 343 and the distal end of the base line segment 341 cooperate with one another to define an opening region 35 thereamong. The indented portion 321 of the first wing section 32 receives the terminal ends of the extension segments 342 and the connecting segment 343 therein.

The base line segment 341 has a length of 52±10 mm in the second direction (Y) and a width of 2±0.5 mm in the first direction (X). Each of the extension segments 342 has a length of 85.8±20 mm in the first direction (X) and a width of 2±0.5 mm in the second direction (Y), and a distance between the extension segments 342 in the second direction (Y) is 3±1 mm. The connecting segment 343 has a width of 2±0.5 mm in the first direction (X).

A distance between the main grounding section 31 and a lower one of the extension segments 342 that is proximate to the main grounding section 31 in the second direction (Y) is 45±10 mm, a distance between the auxiliary conductor 22 and an upper one of the extension segments 342 that is proximate to the auxiliary conductor 22 is 8±2 mm, and a distance between the base line segment 341 and the first wing section 32 in the first direction is 79±20 mm. A distance between the connecting segment 343 and the left side of the indented portion 321 in the first direction (X) is 1.5±0.4 mm, a distance between the upper side of the indented portion 321 and the upper one of the extension segments 342 in the second direction (Y) is 0.9±0.2 mm, and a distance between the lower side of the indented portion 321 and the lower one of the extension segments 342 in the second direction (Y) is 0.5±0.1 mm.

The radiator portion 4 is disposed between the second wing section 33 and the grounding line section 34, and includes a feeding point 41, a base line section 42, two extension sections 43 and a connecting section 44. The feeding point 41 is disposed adjacent to the main grounding section 31. In this embodiment, the feeding point 41 is located on the imaginary line (I) and is adjacent to the main grounding section 31, but the present disclosure is not limited in this respect. The base line section 42 extends from the feeding point 41 toward the conductor portion 2 and has a distal portion close to the conductor portion 2. The extension sections 43 extend from the distal portion of the base line section 42 toward the second wing section 33 in the first direction (X) and are spaced apart from each other in the second direction (Y). The connecting section 44 extends in the second direction (Y) and interconnects terminal ends respectively of the extension sections 43. The extension sections 43, the connecting section 44 and the distal portion of the base line section 42 cooperate with one another to define a radiating region 45 thereamong. The radiator portion 4 and the grounding line section 34 are substantially symmetric with respect to another imaginary line (not shown) extending in the second direction (Y) between the base line segment 341 and the base line section 42.

A distance between the feeding point 41 and the main grounding section 31 in the second direction (Y) is 2±0.5 mm, a distance between the base line section 42 and the base line segment 341 in the first direction (X) is 0.8±0.2 mm, and a distance between the extension sections 43 in the second direction (Y) is 3±1 mm. The base line section 42 has a length of 50±10 mm in the second direction (Y) and a width of 2±0.5 mm in the first direction (X), the connecting section 44 has a width of 2±0.5 mm in the first direction (X), and each of the extension sections 43 has a length of 85±20 mm in the first direction (X) and a width of 2±0.5 mm in the second direction (Y).

A distance between an uppermost end of the second wing section 33 distal from the main grounding section 31 and a lower one of the extension sections 43 in the second direction (Y) is 1±0.2 mm, a distance between the main grounding section 31 and the lower one of the extension sections 43 in the second direction (Y) is 45±10 mm, a distance between the auxiliary conductor 21 and an upper one of the extension sections 43 in the second direction (Y) is 8±2 mm, and a distance between the base line section 42 and the second wing section 33 in the first direction (X) is 81±20 mm.

The length of the first wing section 32 in the second direction (Y) (i.e., 67±15 mm) is larger than the distance between the main grounding section 31 and either/upper one of the extension segments 342 of the grounding line section 34, and the length of the second wing section 33 in the second direction (Y) (i.e., 44±10 mm) is smaller than the distance between the main grounding section 31 and either/lower one of the extension section 43 of the radiator portion 4.

Figure 3:
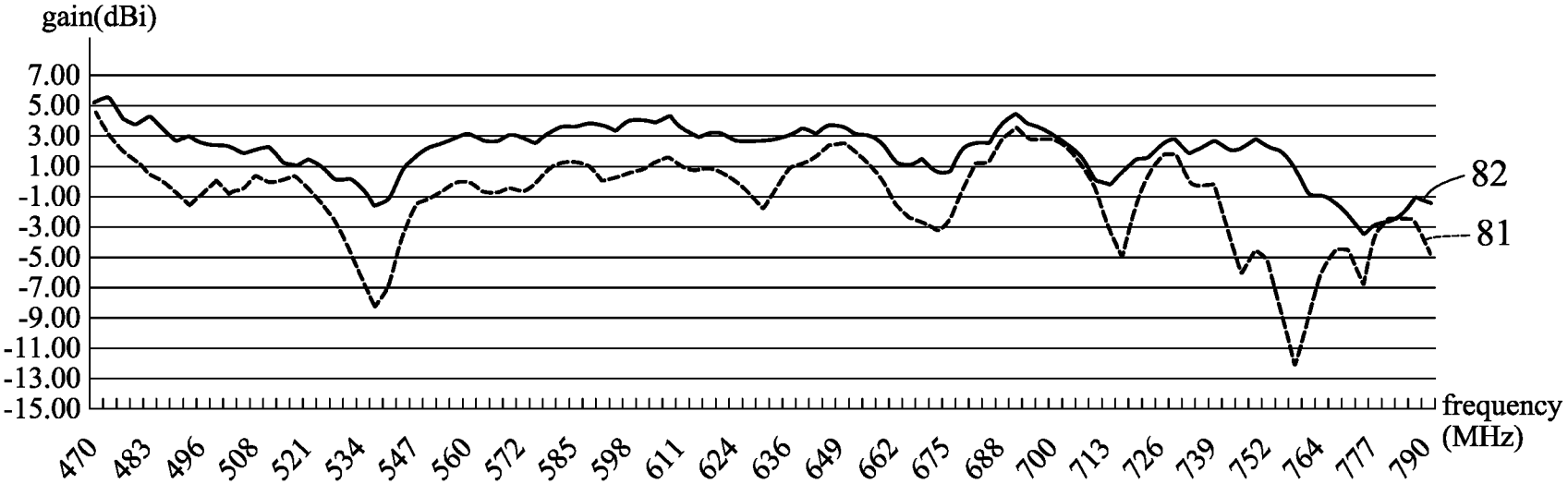
FIG. 3 is a plot showing antenna gain of the conventional antenna in FIG. 1 and the antenna of the first embodiment.

Referring to FIG. 3, a plot illustrating antenna gain of the antenna according to the first embodiment of the present disclosure (indicated by a solid line 82) and antenna gain of the conventional antenna of FIG. 1 (indicated by a dashed line 81) at a frequency band ranging from 470 MHz to 790 MHz is shown. As shown in the plot, the antenna gain of the antenna of the first embodiment is almost always greater than −1 dBi at a frequency band between 470 MHz and 700 MHz, which is generally used for digital television service. Thus, the antenna of the first embodiment has a reception quality better than that of the conventional antenna shown in FIG. 1.

Figure 4:
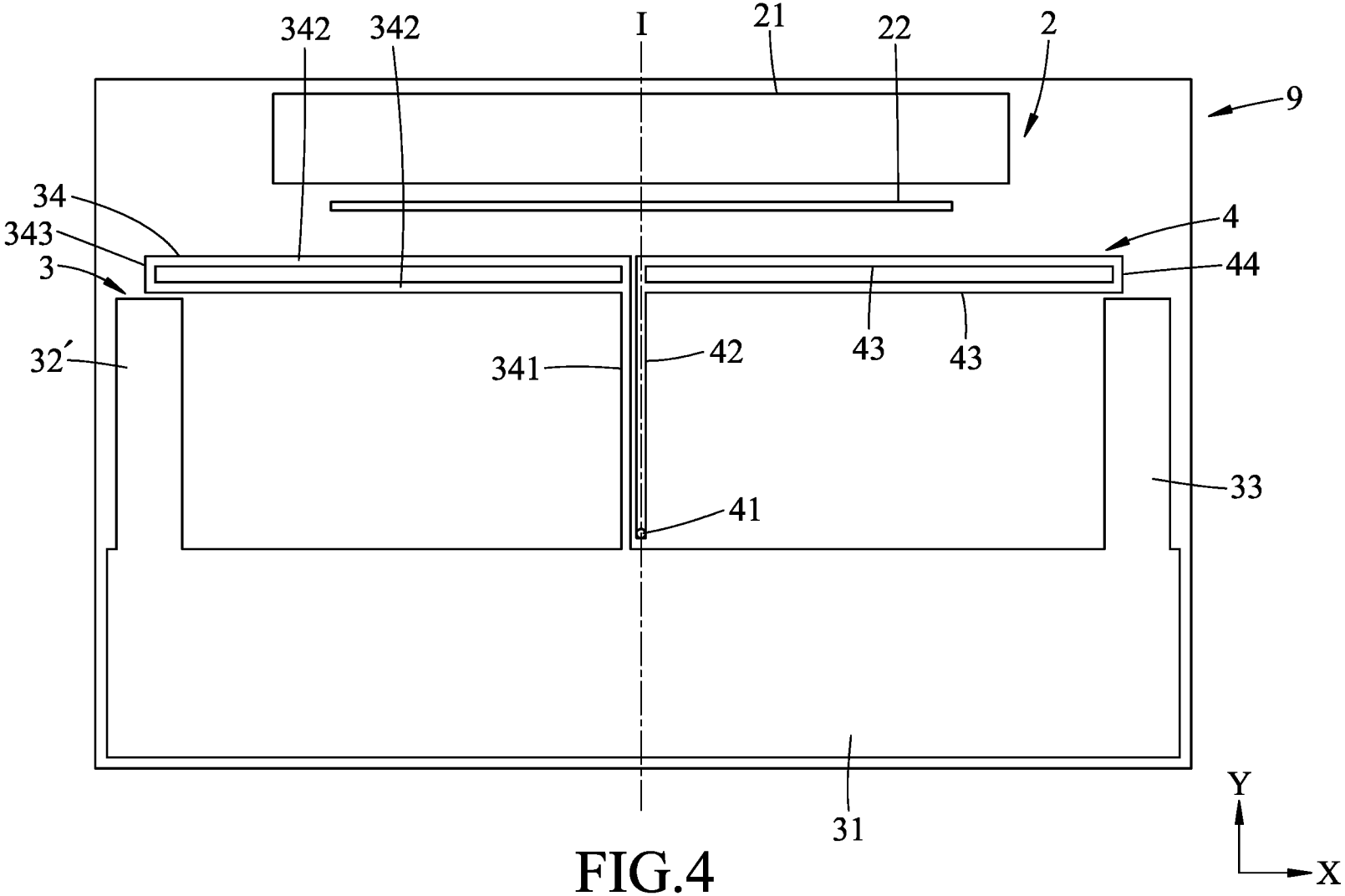
FIG. 4 is a schematic view of an antenna of a second embodiment according to the present disclosure.
Figure 5:
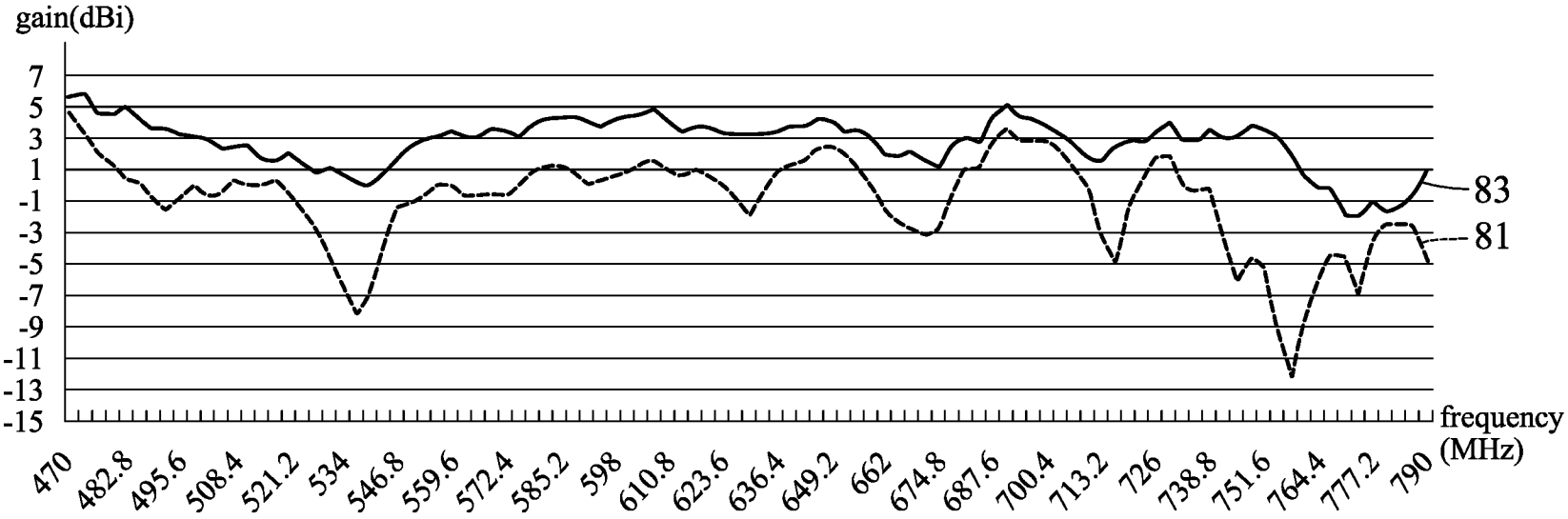
FIG. 5 is a plot showing antenna gain of the conventional antenna of FIG. 1 and the antenna of the second embodiment.

Referring to FIG. 4, an antenna of a second embodiment according to the present disclosure is shown. The second embodiment is similar to the first embodiment, and the difference therebetween resides in that the first wing section 32' in this embodiment has a length in the second direction (Y) smaller than the distance between the lower one of the extension segments 342 and the main grounding section 31, and that the first wing section 32' and the second wing section 33 are substantially symmetric with respect to the imaginary line (I) extending in the second direction (Y). Further referring to FIG. 5, a plot illustrating antenna gain of the antenna of the second embodiment (indicated by a solid line 83) and the same of the conventional antenna (dashed line 81) at the frequency ranging from 470 MHz to 790 MHz is shown. Similarly, the antenna gain of the antenna of the second embodiment is almost always greater than −1 dBi at the frequency band between 470 MHz and 700 MHz. The antenna of the second embodiment has performance similar to that of the antenna of the first embodiment, and has a structure simpler than that of the antenna of the first embodiment. With the abovementioned structures and configurations, wiring of components in the antenna becomes simpler, and amount of raw materials needed and cost for manufacturing the antenna of the second embodiment of the present disclosure can be reduced.

Figure 6:
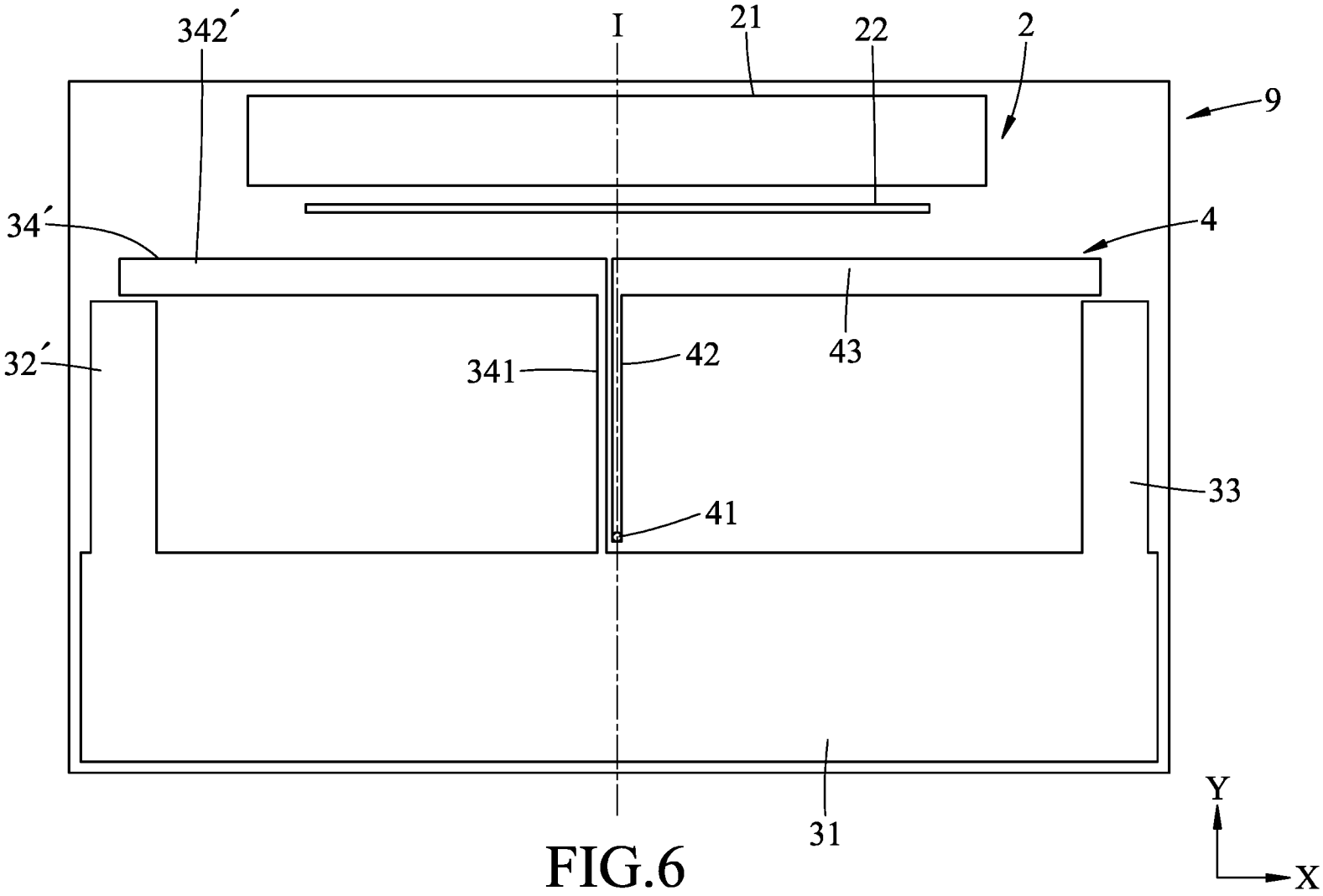
FIG. 6 is a schematic view of an antenna of a third embodiment according to the present disclosure.

Referring to FIG. 6, an antenna of a third embodiment of the present disclosure is similar to that of the second embodiment, with the following differences. In this embodiment, the grounding line section 34' includes only one extension segment 342' extending toward the first wing section 32 in the first direction (X), and the radiator portion 4 includes only one extension section 43 extending toward the second wing section 33 in the first direction (X). The extension segment 342' of the grounding line section 34' of this embodiment has a length of 85.8±20 mm in the first direction (X) and a width of 7±2 mm in the second direction (Y). The extension section 43 of the radiator portion 4 has a length of 85±20 mm in the first direction (X) and a width of 7±2 mm in the second direction (Y).

Figure 7:
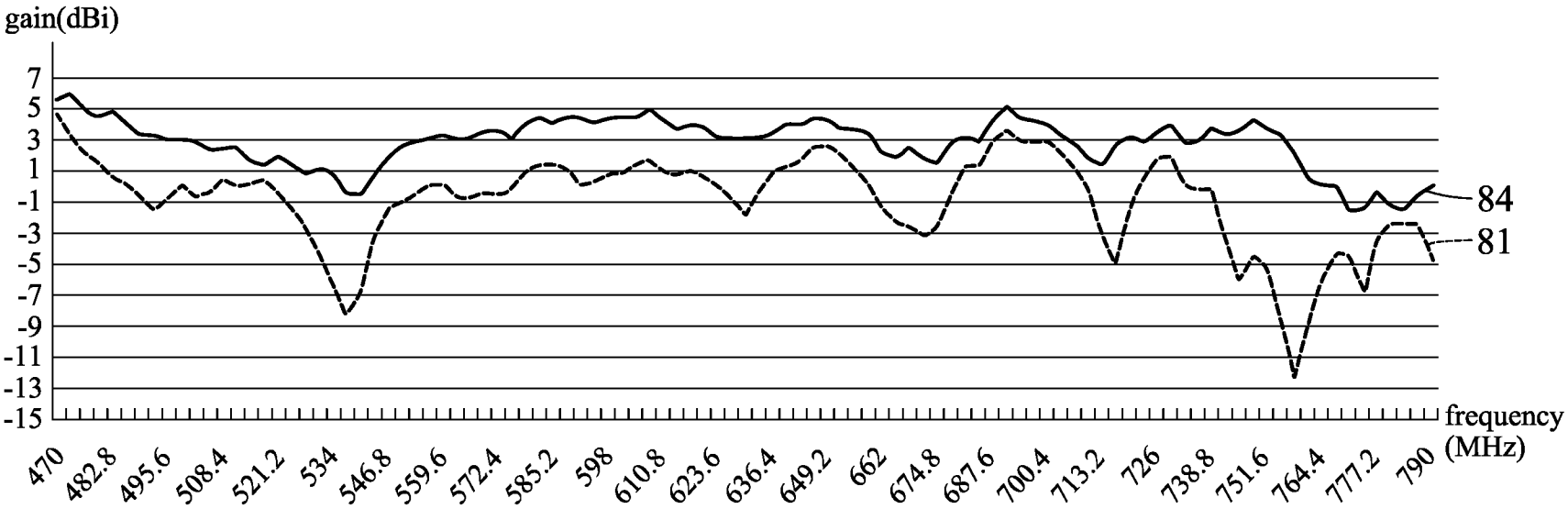
FIG. 7 is a plot showing antenna gain of the conventional antenna of FIG. 1 and the antenna of the third embodiment.

As shown in FIG. 7, a plot illustrating antenna gain of the antenna of the third embodiment and antenna gain of the conventional antenna of FIG. 1 at the frequency ranging from 470 MHz to 790 MHz is shown. The antenna gain of the antenna of the third embodiment is almost always greater than −1 dBi at the frequency band between 470 MHz and 700 MHz. The antenna of the third embodiment also has performance similar to that of the antenna of the first embodiment, and provides advantages of the antenna of the second embodiment.

To sum up, by virtue of the structures and configurations of the conductor 2, the grounding portion 3 and the radiator portion 4, antenna gain of the antenna of the present disclosure can be improved as compared to that of conventional antenna. In this way, efficiency for receiving signals in digital TV can be improved. Additionally, the antenna of the present disclosure is implemented in a single layer structure and thus cost for manufacturing the antenna is relatively low.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An antenna comprising:

a conductor portion extending in a first direction;

a grounding portion including a main grounding section that extends in the first direction, that is spaced apart from said conductor portion in a second direction transverse to the first direction, and that has two ends opposite to each other in the first direction, a first wing section and a second wing section that extend in the second direction respectively from the two ends of said main grounding section toward said conductor portion and that are spaced apart from each other in the first direction, and a grounding line section that extends from said main grounding section and that includes a base line segment extending in the second direction from a portion of said main grounding section between said first wing section and said second wing section toward said conductor portion, and having a distal end close to said conductor portion, and at least one extension segment extending from said distal end of said base line segment in the first direction toward said first wing section; and a radiator portion disposed between said second wing section and said grounding line section, including a feeding point that is disposed adjacent to said main grounding section, a base line section extending from said feeding point toward said conductor portion and having a distal portion close to said conductor portion, and at least one extension section extending from said distal portion of said base line section toward said second wing section.

2. The antenna as claimed in claim 1, wherein said radiator portion and the grounding line section are substantially symmetric with respect to an imaginary line extending in the second direction.

3. The antenna as claimed in claim 1, wherein said first wing section and said second wing section are substantially symmetric with respect to an imaginary line extending in the second direction, said main grounding section is substantially symmetric with respect to the imaginary line, ands aid conductor portion is substantially symmetric with respect to the imaginary line.

4. The antenna as claimed in claim 1, wherein said grounding line section includes two of said extension segments spaced apart from each other in the second direction, and a connecting segment extending in the second direction and interconnecting terminal ends respectively of said extension segments, wherein said extension segments, said connecting segment and said distal end of said base line segment cooperating with one another to define an opening region thereamong.

5. The antenna as claimed in claim 4, wherein said radiator port ion includes two of said extension sections spaced apart from each other in the second direction, and a connecting section extending in the second direction and interconnecting terminal ends respectively of said extension sections, wherein said extension sections, said connecting section and said distal portion of said base line section cooperate with one another to define a radiating region thereamong.

6. The antenna as claimed in claim 5, wherein each of said extension sections of said radiator portion has a length ranging from 65 mm to 105 mm in the first direction and a width ranging from 1.5 mm to 2.5 mm in the second direction.

7. The antenna as claimed in claim 1, wherein said at least one extension section of said radiator portion has a length ranging from 65 mm to 105 mm in the first direction and a width ranging from 5 mm to 9 mm in the second direction.

8. The antenna as claimed in claim 1, wherein said first wing section has a dimension larger than that of said second wing section in the second direction, and is formed with an indented portion that receives a terminal end of said extension segment.

9. The antenna as claimed in claim 8, wherein said first wing section has a dimension in the second direction larger than a distance between said main grounding section and said at least one extension segment of said grounding line section, and said second wing section has a dimension in the second direction smaller than a distance between said main grounding section and said extension section of said radiator portion.

10. The antenna as claimed in claim 1, further comprising a dielectric substrate having opposite surfaces, wherein said conductor portion, said grounding portion and said radiator portion are disposed at the same one of the surfaces of said dielectric substrate.

11. The antenna as claimed in claim 1, wherein said conductor portion includes a main conductor and an auxiliary conductor, both of which extend in the first direction and are spaced apart from each other in the second direction, said auxiliary conductor being disposed between said radiator portion and said main conductor and having an area smaller than that of said main conductor.

* * * * *